United States Patent [19]

Cagle

[11] 3,967,849

[45] July 6, 1976

[54] VACUUM CONTROL SYSTEM

[75] Inventor: Harlan R. Cagle, Clarkston, Mich.

[73] Assignee: Sahlin International, Inc., Birmingham, Mich.

[22] Filed: May 14, 1975

[21] Appl. No.: 577,407

Related U.S. Application Data

[63] Continuation of Ser. No. 369,861, June 14, 1973, abandoned, which is a continuation of Ser. No. 147,322, May 27, 1971, abandoned.

[52] U.S. Cl. ..... 294/64 A; 137/103; 417/184

[51] Int. Cl.[2] ..... B66C 1/02

[58] Field of Search..... 137/103; 294/64 R, 64 A, 294/64 B; 417/183, 184, 191

[56] References Cited

UNITED STATES PATENTS

| | | | |
|---|---|---|---|
| 1,421,842 | 7/1922 | Schmidt | 417/184 X |
| 1,421,843 | 7/1922 | Schmidt | 417/184 |
| 2,200,800 | 5/1940 | Miller | 294/64 A |
| 2,280,658 | 4/1942 | Miller | 294/64 R |
| 2,767,727 | 10/1956 | Acomb | 417/184 X |
| 2,934,086 | 4/1960 | Blatt | 294/64 R X |
| 3,039,623 | 6/1962 | Sehn et al. | 294/64 A X |
| 3,568,959 | 3/1971 | Blatt | 294/64 R |
| 3,598,504 | 8/1971 | Siravo | 417/184 |

*Primary Examiner*—Richard A. Schacher
*Assistant Examiner*—Johnny D. Cherry
*Attorney, Agent, or Firm*—Harness, Dickey & Pierce

[57] ABSTRACT

There is herein disclosed, in association with a high pressure air source and a vacuum cup, a vacuum forming device comprising a vacuum forming member movable between a vacuum forming position and a non-vacuum position by connection to and disconnection from the high pressure air source.

7 Claims, 3 Drawing Figures

INVENTOR.
Harlan R. Cagle
BY
Harness, Dickey & Pierce.
ATTORNEYS.

VACUUM CONTROL SYSTEM

This is a continuation of application Ser. No. 369,861, filed June 14, 1973, now abandoned, which a continuation of application Ser. No. 147,322, filed May 27, 1971, now abandoned.

BACKGROUND AND SUMMARY OF THE INVENTION

Vacuum cup type holding devices are widely used in industry to grip and hold parts during transfer, manufacturing, assembly, and other operations. It is common practice to obtain the necessary vacuum by flow of high pressure air through a vacuum creating device. In some uses of such devices, it is necessary or desirable to be able to quickly and reliably release the parts and one of the problems of prior art devices has been a failure to provide quick and reliable release of the parts.

It is a primary objective of the present invention to provide a new and improved vacuum control system in which a vacuum condition and a non-vacuum condition are positively, reliably, and quickly established by merely stopping and starting air flow through a vacuum creating device. To this end, new and improved vacuum control means have been associated with a vacuum creating device in a new and improved manner. In the presently preferred embodiment of the inventive concepts, the vacuum control means comprises a vacuum forming member movable by the presence or absence of high pressure air between a vacuum forming position and a non-vacuum position. The vacuum forming member is moved to a vacuum forming position when connected to a high pressure air source and is held in that position as long as it is connected to that source. A return means is independently rendered operable by the high pressure air and is operationally independent of the vacuum forming member until disconnected from the high pressure air source whereupon the return means is immediately effective to move the vacuum forming member from the vacuum forming position to the non-vacuum position. In addition, positive vacuum dissipating means are associated with the movable vaccuum forming member and rendered operable immediately upon initiation of movement of the member toward the non-vacuum position to obtain quick and reliable release of parts held by vacuum.

BRIEF DESCRIPTION OF THE DRAWING

An illustrative and presently preferred embodiment of the inventive concepts is shown in the accompanying drawing wherein.

DETAILED DESCRIPTION OF THE INVENTION

Figure 1:
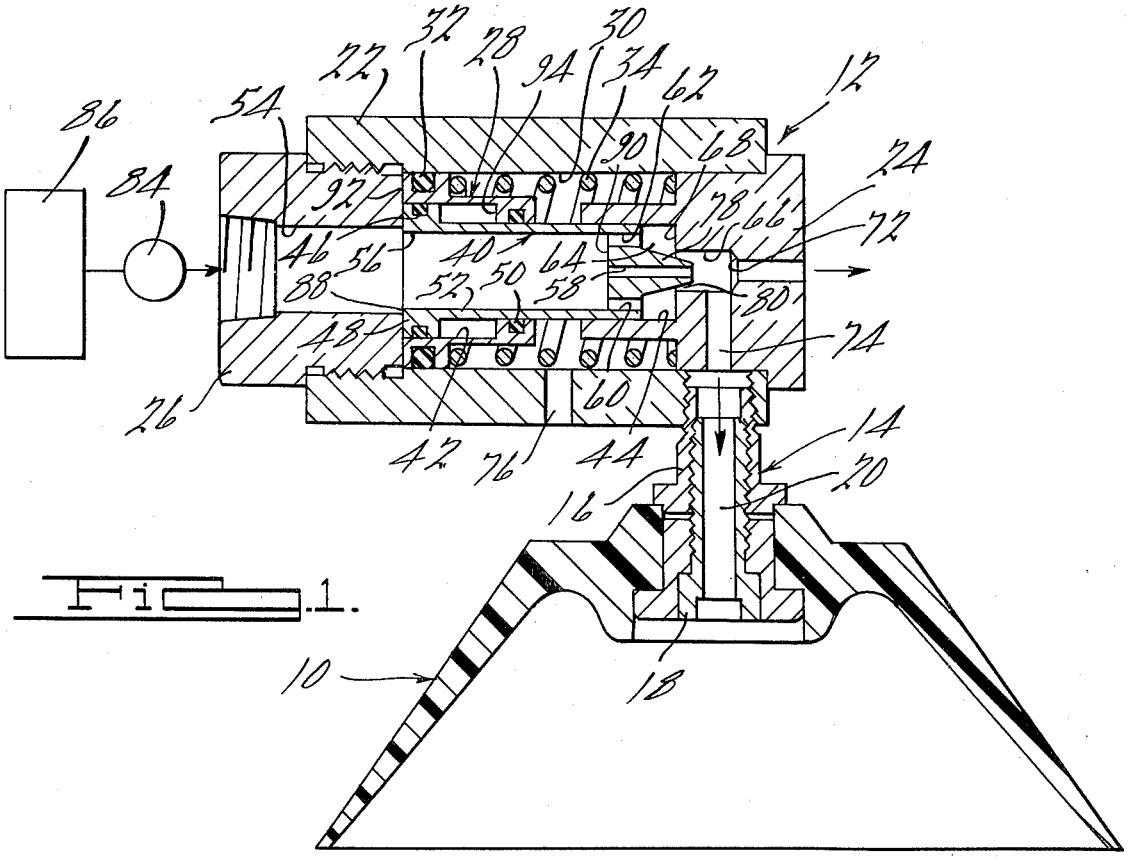
FIG. 1 is a cross-sectional side elevational view of a vacuum forming device and an attached vacuum cup.

Referring now to FIG. 1, a relatively large diameter, e.g. 5 inch, relatively deep, e.g. 1-½ inch, vacuum cup 10 is connected to a vacuum creating device 12 by a threaded coupling 14 comprising a connector member 16 and a locking bolt 18 defining a central air passage 20.

The vacuum creating device 12 comprises an annular housing 22 closed at one end by an annular vacuum forming venturi plug 24 and at the other end by an annular air connection plug 26. An annular axially movable outer sleeve member 28 is slidably mounted on the inner peripheral surface 30 of the housing and sealed relative thereto by sealing means 32. A compression spring 34 is mounted between the sleeve member 28 and the venturi plug 24 to normally bias the sleeve member to an extended position in abutting engagement with the air connection plug 26. The spring 34 is mounted circumjacent hub portions 36, 38 of the outer sleeve member 28 and the venturi plug 24, respectively. An annular movable inner sleeve member 40 provides an axially movable vacuum forming member slidably mounted at one end in an annular chamber 42 in the outer sleeve member 28 and at the other end in annular chamber 44 in the venturi end plug 24. In the presently preferred embodiment, the inner sleeve member 40 is at least partially sealed relative to the outer sleeve member 28 by sealing means 46 carried in an annular piston flange 48 in chamber 42 and sealing means 50 surrounding the annular periphery of central elongated portion 52 of the inner sleeve member. The arrangement is such that the inner sleeve member and the outer sleeve member will move axially as a unit under certain conditions and will be relatively movable under other conditions. While the exact mode of operation under all conditions is not exactly understood at this time, it is believed that the inner and outer sleeves move together as a result of frictional resistance therebetween and due to incompressibility of air trapped therebetween in chamber 42.

Figure 2:
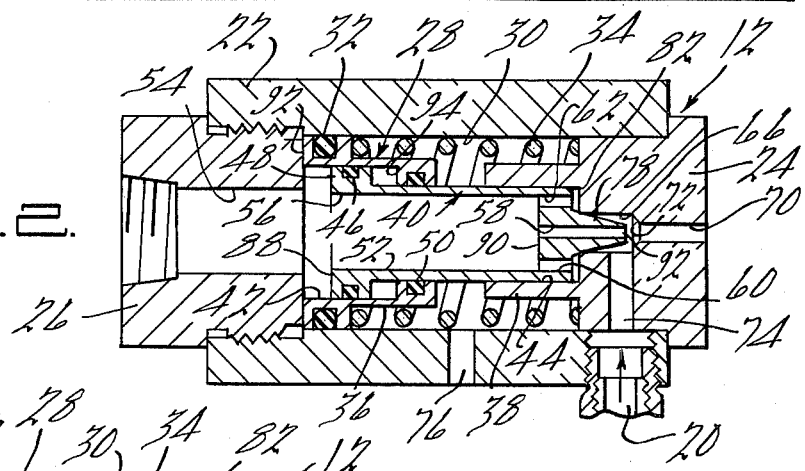
FIG. 2 is a cross-sectional side elevational view of the vacuum forming device of FIG. 1 in another operational position.
Figure 3:
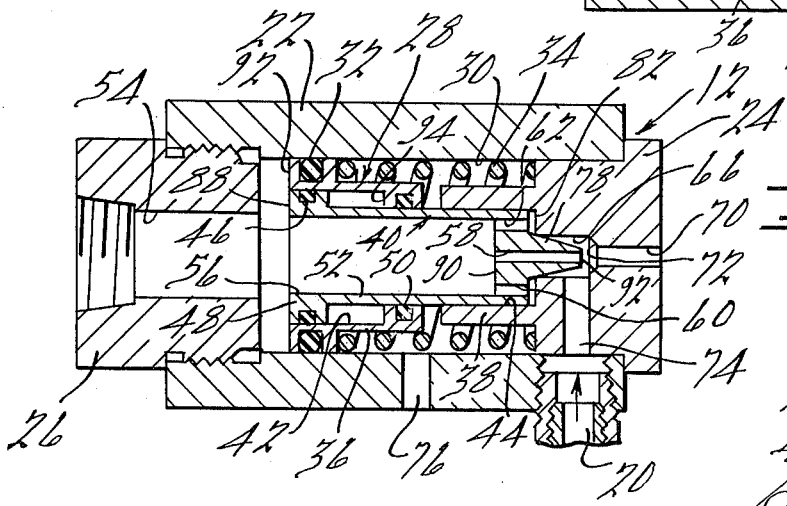
FIG. 3 is another cross-sectional view of the vacuum forming device of FIG. 1 in still another operational position.

A central air passage extending through the vacuum creating device comprises an annular air inlet portion 54 in the end plug; an annular air inlet chamber 56, an annular centrally located air nozzle portion 58, and a plurality of radially outwardly located and circumferentially spaced annular bypass passages 60, 62, there being six in the presently preferred embodiment, in the inner sleeve member 40; a relatively large diameter annular bypass chamber 64 defined by sleeve member 40 and venturi plug 24 in a release position of FIG. 1, an annular outlet chamber 66 of smaller diameter than the bypass chamber and connected thereto by a transverse shoulder 68, and an annular outlet passage 70 of smaller diameter than the outlet chamber 66 and connected thereto by a tapered shoulder 72 in the venturi end plug 24. A transverse vacuum passage 74 is connected to chamber 66 adjacent the tapered shoulder 72 and a transverse vent passage 76 connects the interior of housing 22 to the atmosphere to prevent accumulation of high pressure air therewithin which might block movement of the sleeves 28, 40. A frusto-conical nozzle portion 78 protrudes from the outlet end of the inner sleeve 40 and has a size such as to be radially spaced from and provide a flow passage 80 between the inner wall of chamber 66 in a release position, as shown in FIG. 1, while sealingly abuttingly engaging the intersection edge of surface 68 and chamber 66 to maintain inner sleeve end surface 82 in axially spaced relationship with shoulder 68 in an extended vacuum position as shown in FIGS. 2 and 3.

OPERATION

In operation, with the air inlet passage 54 suitably connected through an on-off type valve 84 to a source of high pressure air 86 of, for example, 80 psi as found in most industrial plants, and the apparatus in a normal non-vacuum, release position as shown in FIG. 1 the high pressure air flows into inlet passage 54 and inner sleeve chamber 56. The high pressure air acts against piston means provided by transverse surfaces 88, 90 and immediately forces the inner sleeve to slide axially from the non-vacuum, release, position of FIG. 1 to a vacuum position as shown in FIGS. 2 and 3 with the tapered outer surface of nozzle 78 seated against the intersection edge of surface 68 to close bypass ports 60, 62 and position the nozzle outlet 90 closely adjacent the outlet passage 70. The outer sleeve 28 is also moved axially against the bias of compression spring 34, during or slightly after the movement of the inner sleeve as indicated, in FIG. 2, by action of the high pressure air against piston means provided by transverse surfaces 92, 94 and by frictional engagement between the inner sleeve and the outer sleeve. There is sufficient leakage of high pressure air around seal 46 to fill chamber 42 in a relatively short time and, if necessary, a port may be provided through the central sleeve portion 52. Chamber 42 provides lost motion means enabling relative movement between the outer sleeve and the inner sleeve so that the inner sleeve will immediately move to the vacuum forming position and remain seated against the intersection edge of surface 68 regardless of variations in the force relationship between the compression spring and the air pressure acting on the piston surfaces. The high pressure air flows through nozzle passage 58 into outlet passage 70 thereby creating a low pressure zone in chamber 66 and causing a flow of air from the vacuum cup through vacuum passages 20, 74. Thus, a workpiece beneath the vacuum cup will be held fast thereagainst until the vacuum condition is dissipated by terminating the flow of high pressure air through the vacuum forming device 12 as hereinafter described.

In the present invention, automatic release means are provided to immediately dissipate the vacuum condition in chamber 66, passages 20, 74, and the vacuum cup when the high pressure air flow is terminated. The outer sleeve 28 and compression spring 34 provide return means for the vacuum forming member 40 which is rendered operative as previously described during the vacuum forming operation by the effects of the high pressure air and held more or less in the position shown in FIG. 3 as long as the high pressure air is on regardless of normal fluctuations in air pressure at the source. During vacuum forming operation, the chamber 42 between the inner and outer sleeves remains filled with high pressure air leaking around the partial seal 46 or through other air passages. When the high pressure air is shut off, the compression spring 34 is immediately effective upon reduction in air pressure to move the outer sleeve to the release position of FIG. 1 with surface 92 abutting the end plug 26. The inner sleeve 52 is also moved simultaneously with the outer sleeve 28 by connecting means provided by friction therebetween and the high pressure air trapped in the chamber 42 which is instantaneously incompressible therein. As soon as bypass ports 60, 62 are opened, a portion of the remaining high pressure air flows through the bypass ports against shoulder 68 to give additional impetus to the movement of the inner sleeve. Thus, the inner sleeve and the outer sleeve are returned more or less as a unit with abutment surface 78 being moved away from shoulder 68 to open passages 60, 62 whereby the remaining high pressure air in the system is discharged through vacuum dissipating air passage means as provided by passages 60, 62, as well as nozzle passage 58 which flow not only destroys further vacuum creating capability by changing the vacuum forming relationship of the parts, but also positively dissipates the existing vacuum in chamber 66 by discharging the remaining high pressure air in the system through both the outlet passage 70 and the vacuum passages 20, 74. Thus, one of the primary difficulties of prior art vacuum cup apparatus has been solved by provision of automatic release control means instantaneously operable when the high pressure air is shut off. A primary advantage of the present invention is the relative insensitivity of the release control means to normal fluctuations in air pressure while at the same time being immediately responsive to the on-off condition of the air supply.

I claim:

1. A vacuum control unit comprising a housing having an air inlet passage at one end and an air outlet passage at the other end, a first sleeve slidably supported in said housing for movement relative to said outlet passage and having an open end communicating with said inlet passage so that incoming air is received within the sleeve, said sleeve having adjacent transverse wall means in the outlet end of the housing, said wall means including aperture means for the passage of air into the outlet passage, means providing a fixed seat for the sleeve around the opening into the outlet passage, said aperture means and said outlet passage being shaped and disposed so that the passage of air under pressure from said air inlet passage through said sleeve and aperture means to said outlet passage holds the sleeve on said seat and during seating creates a vacuum at an inner portion of said outlet passage, a passage in said housing opening at one end into said inner portion of said outlet passage and adapted at the other end for connection to a vacuum operated device, and spring means acting in opposition to inlet air pressure for unseating the sleeve from said seat when the pressure of air on the sleeve drops below a predetermined level, said spring means including a second sleeve slidable on the first and a spring urging the second sleeve toward the inlet end of the housing.

2. A unit as set forth in claim 1 including shoulder means on said first and second sleeve defining an annular air chamber around the first sleeve and providing a lost motion connection between the two sleeves.

3. A vacuum control unit comprising a housing having an air inlet passage at one end and an air outlet passage at the other end, a first sleeve slidably supported in said housing for movement relative to said outlet passage and having an open end communicating with said inlet passage so that incoming air is received within the sleeve, said sleeve having adjacent transverse wall means in the outlet end of the housing, said wall means including aperture means for the passage of air into the outlet passage, means providing a fixed seat for the sleeve around the opening into the outlet passage, said aperture means and said outlet passage being shaped and disposed so that the passage of air under pressure from said air inlet passage through said sleeve and aperture means to said outlet passage holds the sleeve on said seat and during seating creates a vacuum at an inner portion of said outlet passage, a passage in said housing opening at one end into said inner portion of said outlet passage and adapted at the other end for connection to a vacuum operated device, and spring means acting in opposition to inlet air pressure for unseating the sleeve from said seat when the pressure of air on the sleeve drops below a predetermined level, the aperture means in the wall means including a first aperture aligned with said seat and a second aperture displaced laterally from said seat, and means in said housing forming a chamber on the outlet side of said wall means surrounding said seat, said second aperture opening into said chamber, said chamber communicating with the opening in the seat when the first sleeve is unseated.

4. A vacuum control unit comprising a housing having an air inlet passage at one end and an air outlet passage at the other end, a first sleeve slidably supported in said housing for movement relative to said outlet passage and having an open end communicating with said inlet passage so that incoming air is received within the sleeve, said sleeve having adjacent transverse wall means in the outlet end of the housing, said wall means including aperture means for the passage of air into the outlet passage, means providing a fixed seat for the sleeve around the opening into the outlet passage, said aperture means and said outlet passage being shaped and disposed so that the passage of air under pressure from said air inlet passage through said sleeve and aperture means to said outlet passage holds the sleeve on said seat and during seating creates a vacuum at an inner portion of said outlet passage, a passage in said housing opening at one end into said inner portion of said outlet passage and adapted at the other end for connection to a vacuum operated device, and spring means acting in opposition to inlet air pressure for unseating the sleeve from said seat when the pressure of air on the sleeve drops below a predetermined level, said wall means having an outer portion and also included a nozzle portion seatable on and extending through said seat and acting when seated to space said outer portion of the wall means from said seat, said aperture means being in said nozzle portion and in said outer portion of said wall means.

5. A vacuum control system comprising an air inlet chamber adapted to be selectively connected to and disconnected from a high pressure air source, a vacuum forming chamber adapted to be connected to a vacuum operated device, a vacuum forming member mounted between said air inlet chamber and said vacuum forming chamber and being movable relative thereto between a non-vacuum release position and a vacuum forming position, piston means associated with said vacuum forming member and said air inlet chamber and being responsive to a predetermined high pressure condition in said air inlet chamber to move said vacuum forming member to the vacuum forming position to create a vacuum condition and hold the vacuum forming member in the vacuum forming position as long as the predetermined high pressure condition exists in said air inlet chamber, and return means associated with said vacuum forming member and being responsive to a predetermined low pressure condition in said air inlet chamber to immediately move said vacuum forming member to the vacuum release position and thereby dissipate the vacuum condition in the vacuum forming chamber, said vacuum forming member comprising an elongated sleeve portion defining an air passage connected at one end to said air inlet chamber and at the other end to said vacuum forming chamber, a reduced diameter air discharge nozzle portion extending from the other end of said sleeve portion toward said vacuum forming chamber and adapted to be received in said vacuum forming chamber in the vacuum forming position, an abutment shoulder at the other end of said sleeve portion extending radially beyond said nozzle portion, a fixed shoulder adjacent said vacuum forming chamber abuttingly engaging said abutment shoulder on said sleeve portion in the vacuum forming position, vacuum dissipating air passage means at the other end of said sleeve portion opening through said abutment shoulder so as to be closed by said fixed shoulder in the vacuum forming position and open immediately upon actuation of said return means to discharge high pressure air into said vacuum forming chamber to dissipate the vacuum condition therein.

6. The invention as defined in claim 5 and wherein said return means comprises a sleeve member coaxial and slidably associated with said vacuum forming member, lost motion means permitting relative movement between said sleeve member and said vacuum forming member in the vacuum forming position, connecting means causing simultaneous movement of said sleeve member and said vacuum forming member from the vacuum forming position to the non-vacuum release position, and spring means effective in the vacuum forming position to move said sleeve member and said vacuum forming member to the non-vacuum, release, position at and below the predetermined low pressure condition.

7. A vacuum control system comprising an air inlet chamber adapted to be selectively connected to and disconnected from a high pressure air source, a vacuum forming chamber adapted to be connected to a vacuum operated device, a vacuum forming member mounted between said air inlet chamber and said vacuum forming chamber and being movable relative thereto between a non-vacuum release position and a fixed vacuum forming position, piston means associated with said vacuum forming member and said air inlet chamber and being responsive to a predetermined high pressure condition in said air inlet chamber to move said vacuum forming member to the vacuum forming position to create a vacuum condition and hold the vacuum forming member in the vacuum forming position as long as the predetermined high pressure condition exists in said air inlet chamber, and return means associated with said vacuum forming member and being responsive to a predetermined low pressure condition in said air inlet chamber to immediately move said vacuum forming member to the vacuum release position and thereby dissipate the vacuum condition in the vacuum forming chamber, said vacuum forming member having separate first and second passage means for the flow of air through the member when the member is in the release position, and means blocking flow of air through the second passage means when the member is in the vacuum forming position.

* * * * *